US008632210B2

(12) United States Patent
Hochstein

(10) Patent No.: US 8,632,210 B2
(45) Date of Patent: Jan. 21, 2014

(54) LED ENGINE OF FINNED BOXES FOR HEAT TRANSFER

(75) Inventor: Peter A. Hochstein, Troy, MI (US)

(73) Assignee: Relume Technologies, Inc., Oxford, MI (US)

( * ) Notice: Subject to any disclaimer, the term of this patent is extended or adjusted under 35 U.S.C. 154(b) by 236 days.

(21) Appl. No.: 13/145,584

(22) PCT Filed: Aug. 14, 2009

(86) PCT No.: PCT/US2009/053826
§ 371 (c)(1),
(2), (4) Date: Jul. 21, 2011

(87) PCT Pub. No.: WO2010/087877
PCT Pub. Date: Aug. 5, 2010

(65) Prior Publication Data

US 2011/0273879 A1 Nov. 10, 2011

Related U.S. Application Data

(60) Provisional application No. 61/147,931, filed on Jan. 28, 2009.

(51) Int. Cl.
*F21V 1/00* (2006.01)

(52) U.S. Cl.
USPC ..... 362/235; 362/294; 362/373; 362/264; 362/249.02

(58) Field of Classification Search
USPC ..... 362/294, 373, 264, 249.02
See application file for complete search history.

(56) References Cited

U.S. PATENT DOCUMENTS

| | | | | |
|---|---|---|---|---|
| 6,932,495 | B2 * | 8/2005 | Sloan et al. | 362/294 |
| 7,198,387 | B1 * | 4/2007 | Gloisten et al. | 362/294 |
| 7,963,669 | B2 * | 6/2011 | Hockel et al. | 362/249.02 |
| 2007/0274084 | A1 * | 11/2007 | Kan et al. | 362/373 |

FOREIGN PATENT DOCUMENTS

| | | |
|---|---|---|
| EP | 1873447 | 1/2008 |
| JP | 09050458 | 2/1996 |
| JP | 2002093206 | 3/2002 |
| JP | 2007220618 | 8/2007 |

* cited by examiner

*Primary Examiner* — Evan Dzierzynski
(74) *Attorney, Agent, or Firm* — Dickinson Wright, PLLC

(57) ABSTRACT

A light emitting assembly (10) includes a heat sink (12) defined by a plurality of independent sections (14). Each section (14) includes walls (24, 26) extending transversely from the mounting surface (20) to define an open container. Light emitting diodes (52) are disposed at the bottom of each open container. Each section (14) includes first fins (32) extending outwardly from the walls (24, 26) and extending toward the first fins (32) of an adjacent section (14). In one embodiment, the sections (14) can be cantilevered to a planar surface (38) extending longitudinally across an end wall (24) of each section (14). In a second embodiment, the sections (14) can be interconnected by bridges (42) and then vertically mounted to a wall with a mounting bracket (44). The sections (14) can include second fins (34) extending from a heat transfer surface (22) facing opposite the mounting surface (20). The second fins (34) are disposed between the heat transfer surface (22) and the mounting bracket (44).

21 Claims, 6 Drawing Sheets

LED ENGINE OF FINNED BOXES FOR HEAT TRANSFER

CROSS-REFERENCE TO RELATED APPLICATION

This application claims the benefit of provisional application Ser. No. 61/147,931, filed Jan. 28, 2009, and international application number PCT/US2009/053826, filed Aug. 14, 2009.

BACKGROUND OF THE INVENTION

1. Field of the Invention

The subject invention relates to a light emitting assembly of the type including light emitting diodes (L.E.D.s), and more particularly, to the avoidance of high temperatures causing early degradation of the L.E.D.s.

2. Description of the Prior Art

Light assemblies including light emitting diodes are often preferred over other light assembles due to their high efficiency. At least a fifty percent (50%) energy savings is possible when light assemblies including high intensity discharge (H.I.D.) lights are replaced with properly designed L.E.D. light assemblies. An example of such an L.E.D. light assembly is disclosed in U.S. Pat. No. 5,857,767 to the present inventor, Peter A. Hochstein, which is directed to effective thermal management. The '767 patent discloses a light assembly including a plurality of light emitting diodes disposed on a mounting surface of a heat sink. The heat sink includes a plurality of fins to increase the surface area of the heat sink and thus the amount of heat transferred from the light emitting diodes to surrounding ambient air. The expected life of such L.E.D. light assemblies can exceed 10-12 years, compared to a nominal 2-3 year life of H.I.D. light assemblies. When municipalities and other entities retrofit standard H.I.D. light assemblies with L.E.D. light assemblies, the L.E.D. light assemblies typically pay for themselves through energy related cost savings in 4-5 years.

However, as the power densities of L.E.D. assemblies continues to rise, the need for more effective thermal management increases. The cost-benefit calculus of L.E.D. light assemblies is marginal unless the useful life of the L.E.D.s is at least seven years. Unfortunately, thermal management of existing L.E.D. light assemblies may be inadequate at higher power densities due to the orientation of the heat sink, housing, or support of the light assembly. The inadequate or limited thermal management causes the L.E.D. light assemblies to operate at high junction temperatures, which leads to early degradation of the L.E.D.s.

SUMMARY OF THE INVENTION

A L.E.D. light assembly includes a heat sink presenting a mounting surface and an oppositely facing heat transfer surface in a plurality of independent sections each presenting side edges extending between opposite end edges. A plurality of light emitting diodes are disposed on the mounting surface of the sections. Each section includes walls extending transversely from the mounting surface about the side edges and the end edges so that each of the mounting surfaces and surrounding walls define an open container with the light emitting diodes and the mounting surface at the bottom of the open container. The assembly is characterized by each section also including a plurality of first fins extending outwardly from the walls and disposed in spaced relationship to one another for transferring heat away from the sections to surrounding ambient air and a support means extending longitudinally across the sections for supporting the sections in spaced relationship to one another with the first fins of adjacent sections extending toward one another in the space between sections.

ADVANTAGES OF THE INVENTION

The light emitting assembly provides improved thermal management of L.E.D. light assemblies mounted to a planar support structure. The walls and first fins of the light assembly provide additional surface area exposed to ambient air to transfer heat from the L.E.D.s to the surrounding ambient air. Further, the orientation of the first fins relative to the support means provides for effective convective cooling of the light assembly. Cool ambient air from below the light assembly can enter the light assembly and flow past the support means and along the walls between the first fins to extract heat from the heat sink to become heated air, of lower density, which travels upward and out of the light assembly, analogous to a chimney effect. In addition, the light emitting diodes are protected by the walls so that an additional housing is not necessary. Thus, ambient air entering the light assembly is not trapped between the fins or blocked from flowing through the light assembly by a housing or support means. Thus, improved thermal management of L.E.D. light assemblies can be achieved, including those with high power densities.

BRIEF DESCRIPTION OF THE DRAWINGS

Other advantages of the present invention will be readily appreciated, as the same becomes better understood by reference to the following detailed description when considered in connection with the accompanying drawings wherein.

DETAILED DESCRIPTION OF THE INVENTION

Figure 6:
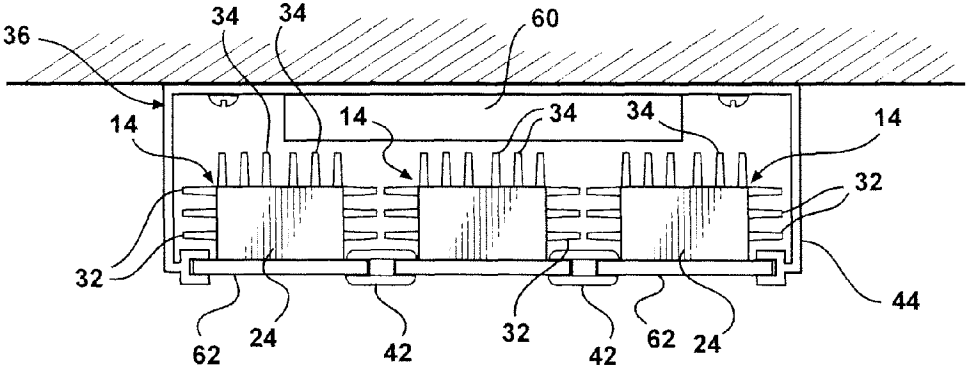
FIG. 6 is a plan (top) view of the second embodiment shown in FIG. 4.
Figure 7:
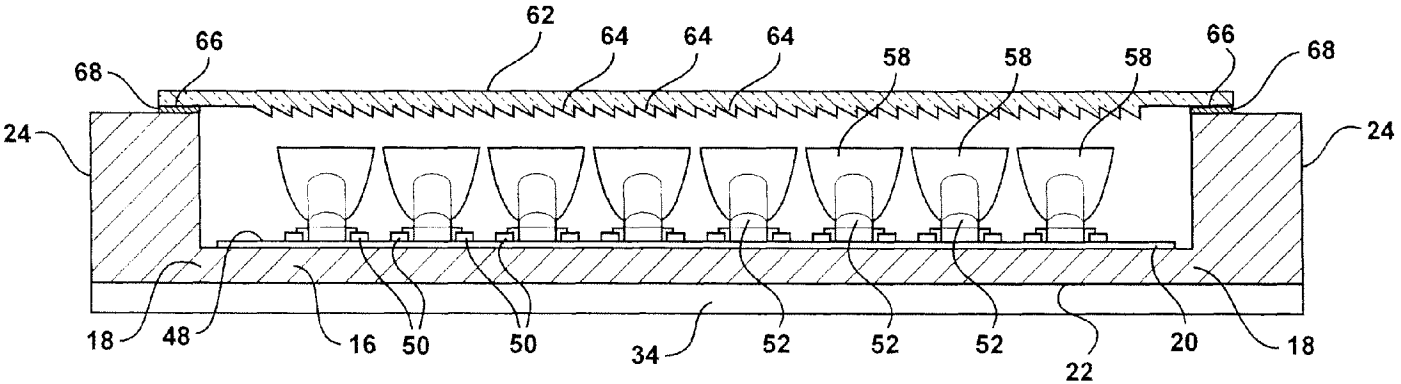
FIG. 7 is a cross sectional view of FIG. 5 along line 7-7.

Referring to the Figures, a light emitting assembly is generally shown at 10. The light emitting assembly 10 comprises a heat sink 12 of electrically and thermally conductive aluminum material, preferentially homogenous aluminum or an aluminum alloy. As shown in FIGS. 1, 3, 4 and 6, the heat sink 12 is divided into a plurality of independent sections 14 each presenting side edges 16 extending between opposite end edges 18. Each section 14 of the heat sink 12 presents a mounting surface 20 and an oppositely facing heat transfer surface 22, as shown in FIG. 7. The side edges 16 and end edges 18 interconnect the mounting surface 20 and the heat transfer surface 22. Typically, the mounting surface 20 is defined by an elongated rectangular shape extending between the end edges 18, as shown in FIG. 2. However, the mounting surface 20 and oppositely facing heat transfer surface 22 can have a variety of other shapes.

Each independent section 14 includes end walls 24 extending transversely from the mounting surface 20 at the end edges 18. Each independent section 14 also includes side walls 26 extending transversely from the mounting surface 20 at the side edges 16 so that each of the mounting surfaces 20 and surrounding walls 24, 26 define an open container, as shown in FIG. 2. The end walls 24 extend from the mounting surface 20 to top end edges 28 and the side walls 26 extend from the mounting surface 20 to top side edges 30, as shown in FIG. 2.

Each independent section 14 includes a plurality of first fins 32 extending outwardly from the side walls 26. The first fins 32 on the side walls 26 of adjacent sections 14 extend toward one another in the space between the sections 14, as shown in FIGS. 1, 3, 4 and 6. The first fins 32 can also extend from the end walls 24, as showing in FIG. 2. Each of the sections 14 can include a plurality of second fins 34 extending outwardly from the heat transfer surface 22, as shown in FIGS. 4, 5, and 6. The first and second fins 32, 34 are disposed in spaced and typically parallel relationship to one another for transferring heat away from the sections 14 to surrounding ambient air. The fins 32, 34 are disposed and oriented on the walls 24, 26 relative to the end edges 18, side edges 16, and heat transfer surface 22 to allow convective cooling of each of the sections 14.

Figure 1:
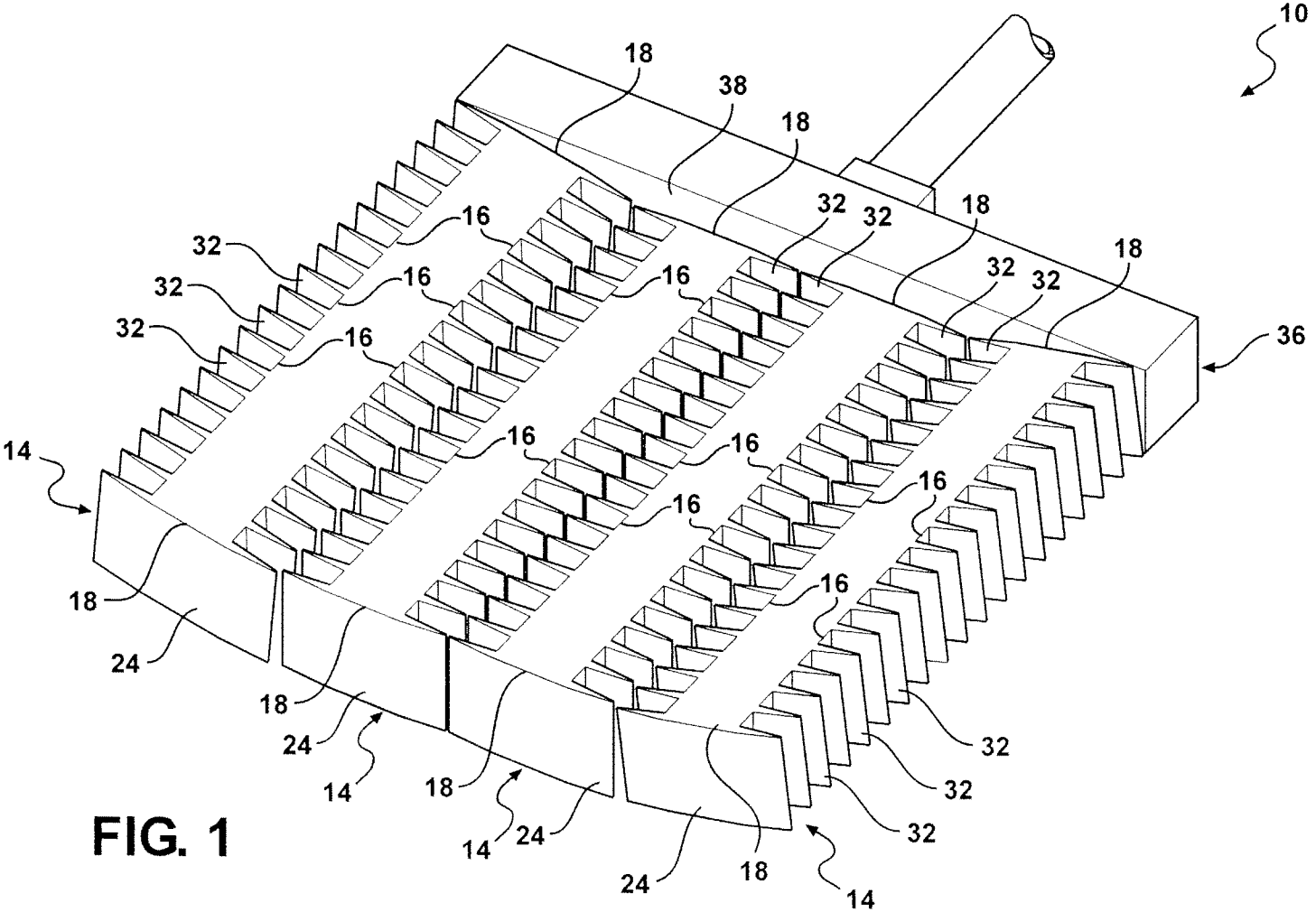
FIG. 1 is perspective view of a first embodiment of the subject invention wherein a plurality of sections are cantilevered from a planar surface.
Figure 2:
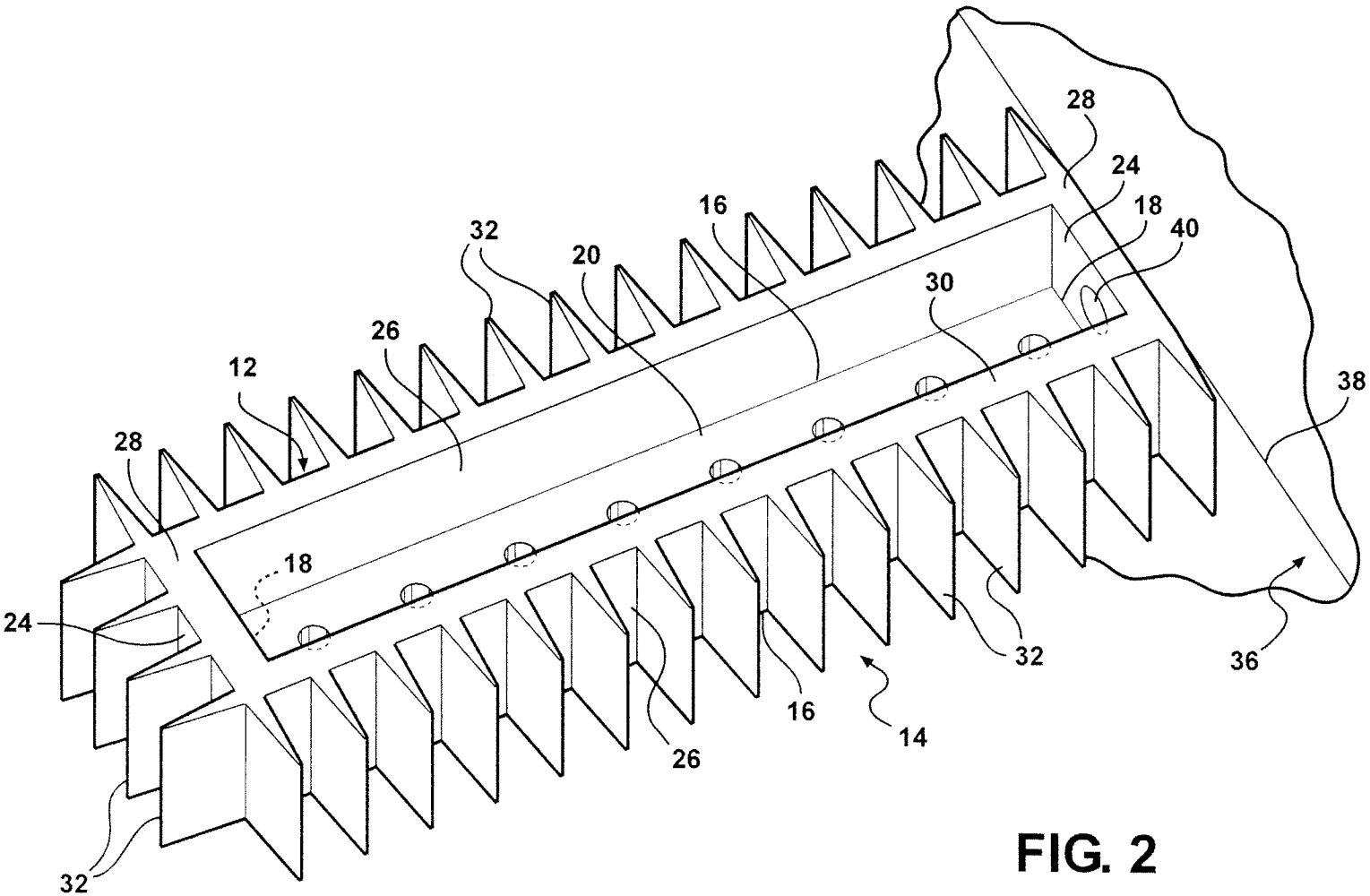
FIG. 2 is a perspective view of a single section of the first embodiment shown in FIG. 1.
Figure 3:
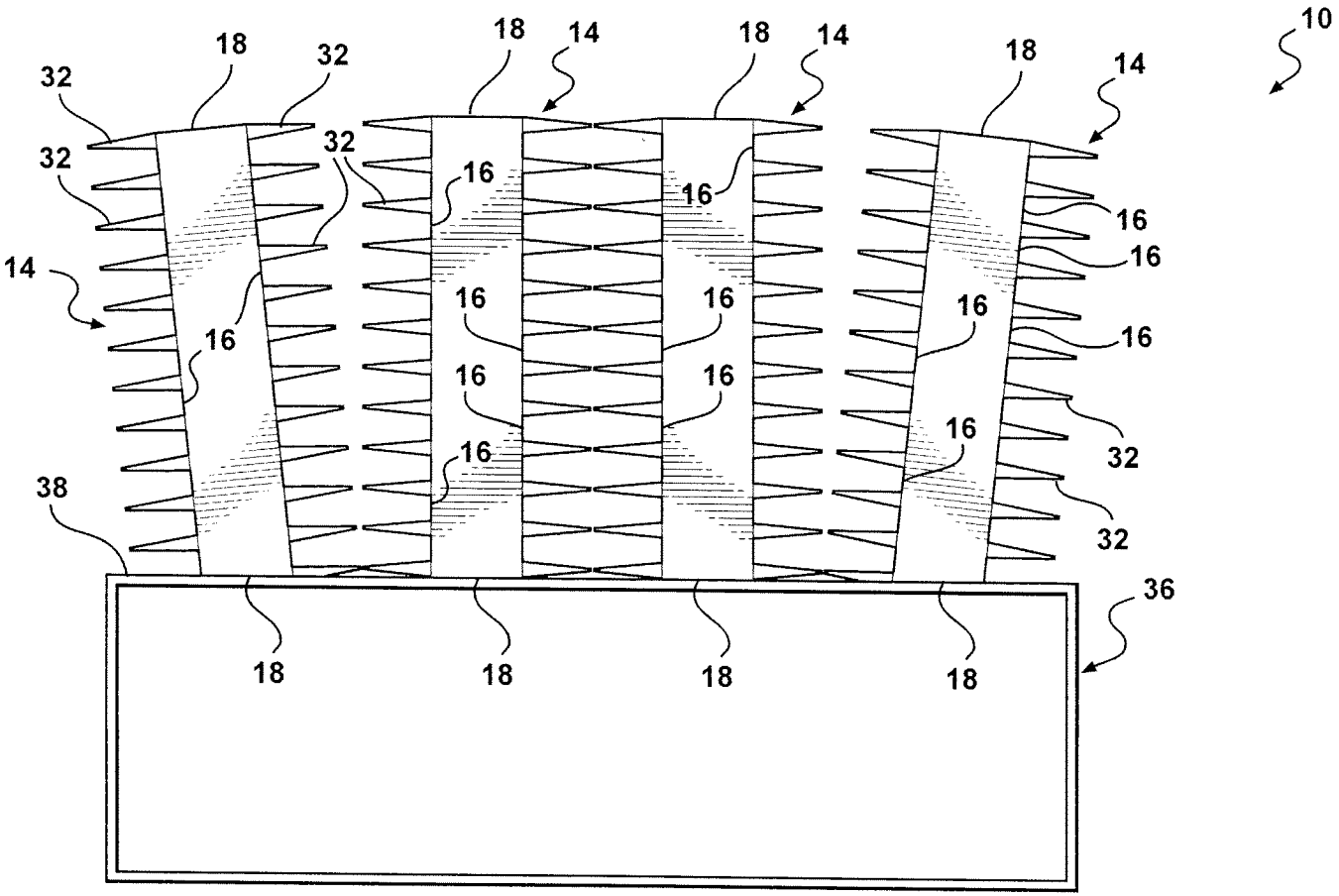
FIG. 3 is a plan (top) view of the first embodiment shown in FIG. 1.
Figure 4:
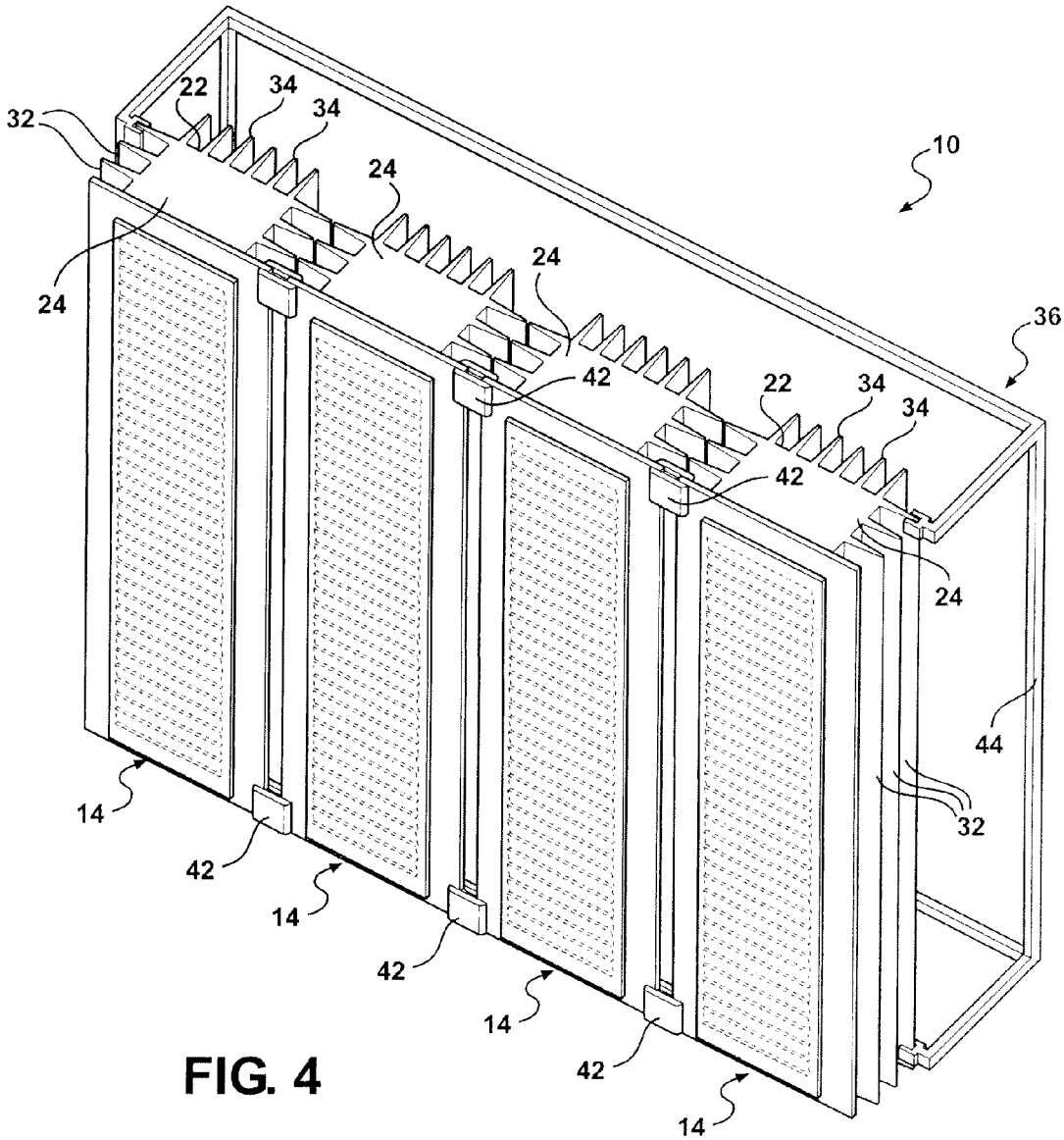
FIG. 4 is a perspective view of a second embodiment of the subject invention including bridges and a mounting bracket.
Figure 5:
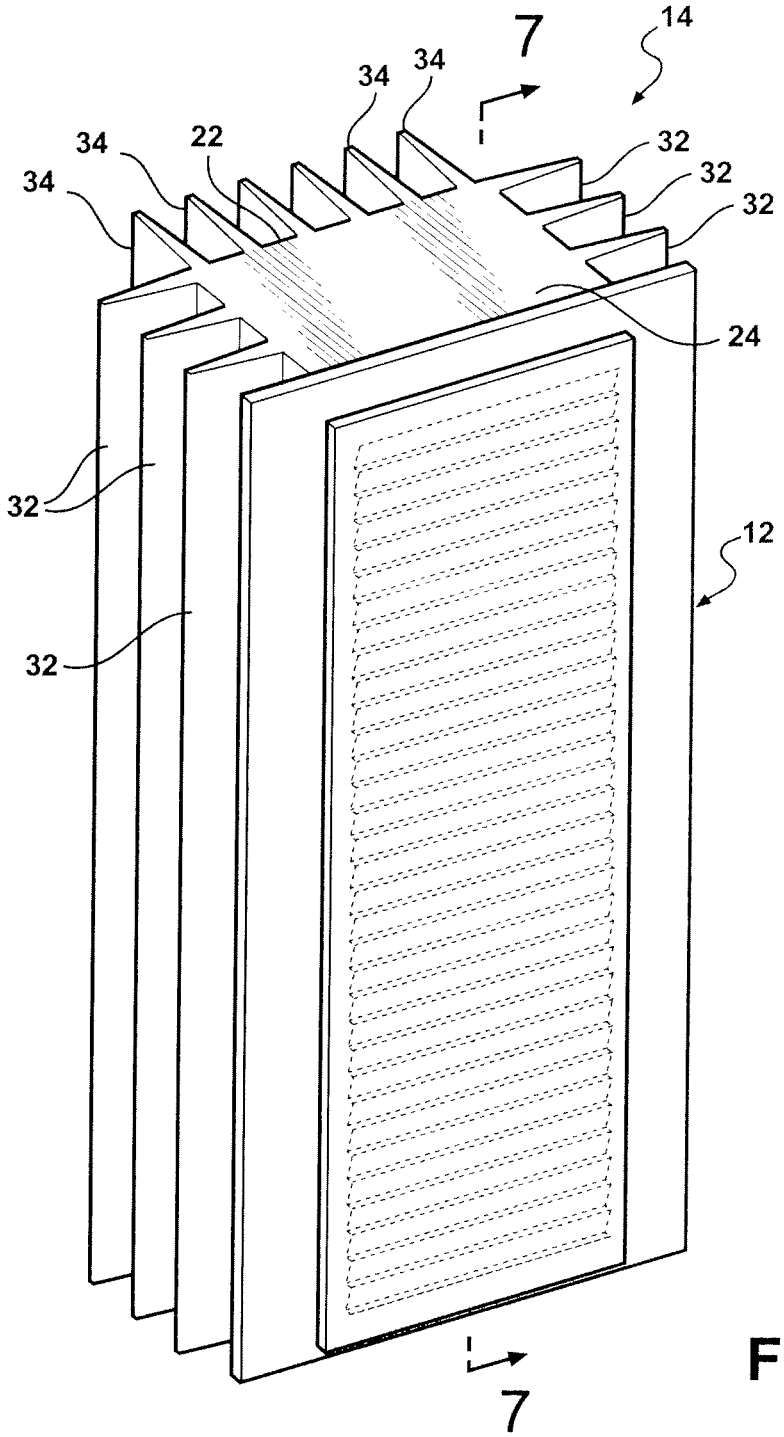
FIG. 5 is a perspective view of a single section of the second embodiment shown in FIG. 4.

The independent sections 14 are typically disposed in parallel or generally parallel relationship to one another, as shown in FIGS. 1, 4, and 6 but can be disposed at angles relative to one another, as shown in FIG. 3. At least one of the sections 14 can be canted at an angle relative to the other sections 14, as shown in FIG. 1. The sections 14 are typically shaped like an open rectangular box, wherein each of the side walls 26 are linear and parallel to one another, as shown in the FIG. 2. However, the sections 14 can be coffin-shaped, or other shapes to define the open container. For example, each of the walls 24, 26 can be non-linear or disposed at angles relative to one another. Each side wall 26 of one of the sections 14 can be the same length as the other side wall 26 of the section 14, as shown in FIG. 1, or different lengths from the other side wall 26 of the section 14, as shown in FIG. 3. The end walls 24 of one of the sections 14 can also be the same length or different lengths from one another. Further, the sections 14 can be shaped identical to or different from one another. The light assembly 10 typically includes a plurality of the sections 14, as described above, but alternatively can include a single section 14, as shown in FIGS. 2 and 5.

Each section 14, including the mounting surface 20, heat transfer surface 22, walls 24, 26 and fins 32, 34, can be formed by a single casting process. Alternatively, portions of the sections 14 can be forged or otherwise formed separately from one another, and then assembled to define the open container. For example, a continuous strip of the heat sink 12 having a cross section presenting the mounting surface 20 and heat transfer surface 22 can be formed and then cut into a plurality of pieces each presenting the mounting surface 20 and heat transfer surface 22. In other words, the mounting surface 20 and heat transfer surface 22 of the sections 14 can be formed separate from the walls 24, 26. A continuous tube of the heat sink 12 having a cross section presenting the side walls 24 and end walls 26 and first fins 32 extending outwardly from the walls 24, 26 can be extruded and then cut into a plurality of wall units each presenting the side walls 24 and end walls 26 and first fins 32. In other words, the walls 24, 26 of the sections 14 can be formed separate from forming the mounting surface 20 and heat transfer surface 22. Subsequently, the mounting surfaces 20 and the walls 24, 26 can be welded together or otherwise connected, for example by pressing or coining. In other words, the mounting surface 20 of one of the sections 14 can be connected to one of the wall units.

The light emitting assembly 10 includes a support means 36 for supporting the sections 14 in spaced and generally parallel relationship to one another, as shown in FIGS. 1, 3, 4 and 6. The support means 36 extends longitudinally across the sections 14 and transverse to the first fins 32 so that ambient air can flow between the first fins 32 and over the walls 24, 26 of the sections 14. Thus, the location of the support means 36 relative to the end walls 24, side walls 26, and heat transfer surfaces 22 depends on the mounting of the assembly 10.

In a first embodiment, the light emitting assembly 10 can be mounted horizontally relative to the ground to direct light toward the ground, which is ideal for street light assemblies 10. In this embodiment, the support means 36 includes a planar surface 38, and the sections 14 of the light emitting assembly 10 can be cantilevered from the planar surface 38, as shown in FIGS. 1 and 3. Typically, at least one of the end walls 24 of each section 14 does not include the first fins 32, and the planar surface 38 extends longitudinally along the end wall 24 without the first fins 32 of each section 14. In this embodiment, the support means 36 also includes a connecting means 40 to connect one of the end walls 24 without the first fins 32 of each section 14 to the planar surface 38 in the cantilevered fashion. The connecting means 40 can include a bolt or screw, as shown in FIG. 2, or other type of connector. Alternatively, the connecting means 40 may constitute a coined or welded boss. In the first embodiment, each of the first fins 32 extend continuously between the heat transfer surface 22 and the top side edges 30 of the side walls 26 of each section 14, as shown in FIG. 1. The first fins 32 can also extend continuously between the heat transfer surface 22 and the top end edge 28 of one of the end walls 24 of each section 14, as shown in FIG. 2. Ambient air from below the light assembly 10 can enter the light assembly 10 and flow upward over the side walls 26 between the first fins 32. The air can flow continuously between the heat transfer surface 22 and top side edges 30 of each section 14.

In a second embodiment, the light emitting assembly 10 can be mounted vertically relative to the ground, which is ideal for light assemblies 10 mounted on vertical planar wall surfaces in parking structures or in other enclosed areas requiring light. In this embodiment, the support means 36 can include bridges 42 interconnecting adjacent elongated sections 14 to maintain the elongated sections 14 connected together, as shown in FIGS. 4 and 6. Each bridge 42 can interconnect two of the sections 14 adjacent one another, as shown in FIGS. 4 and 6. Typically, a pair of the bridges 42 are disposed between adjacent sections 14, but the sections 14 can be interconnected by a single bridge 42 or more than two bridges 42. The bridges 42 can be made of steel, or another material capable of maintaining the light assemblies 10 connected together. The bridges 42 can also include a coupler or vertical stiffening rib.

In the second embodiment, the support means 36 can also include a mounting bracket 44 for mounting the connected sections 14 to a wall, as shown in FIGS. 4 and 6. The mounting bracket 44 extends transversely from at least one of the sections 14 of the light assembly 10. Typically, the mounting bracket 44 is U-shaped, as shown in FIGS. 4 and 6. The base of the U-shaped mounting bracket 44 can be disposed along the wall, and each side of the U-shaped mounting bracket 44 can be attached to one of the first fins 32 on an outer side wall 26 of the light assembly 10, as shown in FIGS. 4 and 6. The mounting bracket 44 can be attached to the sections 14 by a clamp, adhesive, bolt, screw, or another type of connection modality. The mounting bracket 44 is typically bolted or screwed to the wall. The mounting bracket 44 can be made of steel or another material, and is typically formed by an extrusion or casting process.

In the second embodiment, each of the first fins 32 extend continuously between the end walls 24 along the side walls 26 of the sections 14, as shown in FIGS. 4, 5, and 6. The first fins 32 are oriented so that ambient air can flow between the first fins 32 and over the side walls 26, continuously between the end walls 24 of each section 14. In this embodiment, each of the sections 14 typically include a plurality second fins 34 extending outwardly from the heat transfer surface 22, as shown in FIGS. 4, 5, and 6. The second fins 34 are disposed between the heat transfer surface 22 and the mounting bracket 44 or other support means 36 so that ambient air can flow between the second fins 34 and over the heat transfer surface 22, as shown in FIGS. 4 and 6. The second fins 34 of the sections 14 can be spaced from the U-shaped mounting bracket 44 so that ambient air can flow between the sections 14 and the mounting bracket 44 to enhance convective cooling.

Figure 8:
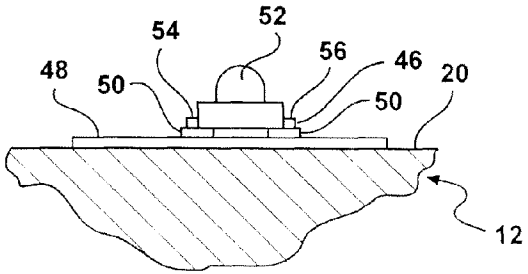
FIG. 8 is an enlarged fragmentary cross sectional view of a light emitting diode and associated electrical elements used in the subject invention.

The light assembly 10 includes a coating 48, as shown in FIG. 8, disposed on the mounting surface 20 of each section 14, at the bottom of the open container. The coating 48 can be disposed continuously over the mounting surface 20, or in a plurality of patches separated from one another by the bare metal of the heat sink 12. The coating 48 includes an electrically insulating material and is typically less than one thousand microns thick, but preferably less than three hundred microns thick.

Circuit traces 50 are disposed in spaced lengths from one another on the coating 48 to prevent electrical conduction between the circuit traces 50 and to prevent electrical conduction from each of the circuit traces 50 to the heat sink 12. The circuit traces 50 can extend in end to end relationship along the sections 14, as shown in FIG. 7. The traces 50 may consist of a polymetric material having metal particles dispersed therein, such as an expoxy compound with a noble metal, or a phenolic resin compounded with either copper, silver, or nickel.

The light assembly 10 includes a plurality of light emitting diodes 52 each disposed over the coating 48 on the mounting surface 20 at the bottom of the open container, as shown in FIGS. 7 and 8. The light emitting diodes 52 on each section 14 are shown with a uniform space between each adjacent light emitting diode 52. However, the light emitting diodes 52 may have non-uniform spaces between one another. Each light emitting diode 52 has a positive lead 54 and a negative lead 56, as shown in FIG. 8. The leads 54, 56 of each light emitting diode 52 are in electrical engagement with the adjacent ones of the circuit traces 50 for electrically interconnecting the circuit traces 50 and the light emitting diodes 52. An adhesive 46 of electrically conductive material secures the leads 54, 56 to the circuit traces 50, as shown in FIG. 8. The light emitting diodes 52 on each section 14 can be electrically interconnected in series with one another and electrically interconnected in parallel with the light emitting diodes 52 on other sections 14. The light assembly 10 can also include a plurality of collimators 58 each encompassing one of the light emitting diodes 52, as shown in FIG. 7. The collimators 58 focus a broad beam of light emitting from the light emitting diodes 52 into a more parallel beam of light.

Typically, the mounting surfaces 20 of the sections 14 are formed separate from the walls 24, 26 as described above, and the coating 48, circuit traces 50, light emitting diodes 52, and other electrical components can be disposed on the mounting surface 20 before the mounting surface 20 and walls 24, 26 are connected. Applying the coating 48, circuit traces 50, light emitting diodes 52, and other electrical components before connecting the mounting surface 20 to the walls 24, 26 provides for open access to the mounting surface 20 from all angles, without hindrance by the walls 22, 24. Alternatively, when the sections 14 are formed by the single casting process, the coating 48, circuit traces 50, light emitting diodes 52, and other electrical components can be disposed on the bottom of the open container.

A power supply 60 can be connected to the electrical components of the light assembly 10 to supply power to the light emitting diodes 52. The electrical components of the light assembly 10 are connected to the power supply 60 with printed, foil, or wire conductors, and the conductor feedthroughs must be sealed when the assembly 10 is used outdoors. In the first embodiment shown in FIGS. 1 and 3 including the cantilevered sections 14, the power supply 60 can be disposed inside the planar surface 38. In the second embodiment shown in FIG. 6 including the vertically mounted sections 14, the power supply 60 can be attached to the mounting bracket 44 and disposed between the mounting bracket 44 and the second fins 34.

Each section 14 of the light emitting assembly 10 includes a lens sheet 62 spanning and closing the open container between the top edges 28, 30 of the walls 24, 26, as shown in FIGS. 4, 5, 6, and 7. The lens sheet 62 includes a light transmitting material for allowing light emitting from the light emitting diodes 52 to pass therethrough. The lens sheet 62 may also include a plurality of prisms 64, as shown in FIG. 7, for deflecting the beam of light emitting from the light emitting diodes 52. The prisms 64 can direct the light in a predetermined direction. The light assembly 10 can include a lens seal 66 disposed between the lens sheet 62 and the top edges 28, 30, as shown in FIG. 7, for sealing the lens sheet 62 to the top edges 28, 30 of the walls 24, 26. The lens seal 66 prevents ambient air, precipitation, and other debris from entering the open container. The light assembly 10 also includes a securing means 68 for securing the lens sheet 62 to the top edges 28, 30 of the walls 24, 26 of the sections 14. The securing means 68 can include an adhesive, as shown in FIG. 7, or a mechanical fastener, such as a frame, bolts, or screws.

Obviously, many modifications and variations of the present invention are possible in light of the above teachings and may be practiced otherwise than as specifically described while within the scope of the appended claims. In addition, the reference numerals in the claims are merely for convenience and are not to be read in any way as limiting.

What is claimed is:

1. A light emitting assembly (10) comprising;

a heat sink (12) presenting a mounting surface (20) and an oppositely facing heat transfer surface (22), said heat sink (12) including a plurality of independent sections (14) each presenting side edges (16) extending between opposite end edges (18), a plurality of light emitting diodes (52) (LEDs) disposed on said mounting surface (20) of said sections (14), each of said sections (14) including walls (24, 26) extending transversely from said mounting surface (20) about said side edges (16) and said end edges (18) so that each of said mounting surfaces (20) and surrounding walls (24, 26) define an open container with said light emitting diodes (52) and said mounting surface (20) at the bottom of said open container, and characterized by each of said sections (14) including a plurality of first fins (32) extending outwardly from said walls (24, 26) and disposed in spaced relationship to one another for transferring heat away from said sections (14) to surrounding ambient air, and a support means (36) extending longitudinally across said sections (14) for supporting said sections (14) in spaced relationship to one another with said first fins (32) of adjacent sections (14) extending toward one another in the space between sections (14).

2. An assembly (10) as set forth in claim 1 wherein said sections (14) are elongated and said first fins (32) extend transverse to said longitudinally extending support means (36) for allowing ambient air to flow between said first fins (32) and over said walls (24, 26) of adjacent sections (14).

3. An assembly (10) as set forth in claim 1 wherein said walls (24, 26) include end walls (24) extending transversely from said mounting surface (20) at said end edges (18) to top end edges (28) and side walls (26) extend transversely from said mounting surface (20) at said side edges (16) to top side edges (30).

4. An assembly (10) as set forth in claim 3 wherein said first fins (32) extend continuously between said end walls (24) on said side walls (26) of said sections (14).

5. An assembly (10) as set forth in claim 4 wherein said support means (36) includes a plurality of bridges (42) interconnecting adjacent sections (14) to maintain said sections (14) connected together and, a mounting bracket (44) extending transversely from at least one of said sections (14) for mounting said light assembly (10) to a wall.

6. An assembly (10) as set forth in claim 4 wherein each of said sections (14) includes a plurality of second fins (34) extending continuously between said end walls (24) and outwardly from said heat transfer surface (22) and disposed in spaced relationship to one another for transferring heat away from said sections (14) to surrounding ambient air.

7. An assembly (10) as set forth in claim 6 wherein said second fins (34) are disposed between said heat transfer surface (22) and said support means (36) for allowing ambient air to flow between said second fins (34) and over said heat transfer surface (22) of said sections (14).

8. An assembly (10) as set forth in claim 3 wherein said first fins (32) extend continuously between said heat transfer surface (22) and said top side edges (30) of said side walls (26) of said sections (14).

9. An assembly (10) as set forth in claim 8 wherein:

said support means (36) presents a planar surface (38) extending longitudinally along one of said end walls (24) of each of said sections (14), and said support means (36) includes a connecting means (40) connecting said end walls (24) of each of said sections (14) to said planar surface (38) for cantilevering said sections (14) from said planar surface (38).

10. An assembly (10) as set forth in claim 1 wherein said mounting surface (20) of each of said sections (14) is a separate piece independent of said walls (24, 26) of said sections (14).

11. An assembly (10) as set forth in claim 1 including a lens sheet (62) spanning said open container between said walls (24, 26) of each of said sections (14).

12. An assembly (10) as set forth in claim 1 wherein at least one of said sections (14) is canted at an angle relative to another one of said sections (14).

13. An assembly (10) as set forth in claim 1 wherein at least two of said sections (14) are disposed in non-parallel relationship relative to one another.

14. An assembly (10) as set forth in claim 1 including said heat sink (12) being formed of electrically and thermally conductive aluminum material, said heat sink (12) being defined by said plurality of independent sections (14) with said side edges (16) and said end edges (18) interconnecting said mounting surface (20) and said heat transfer surface (22)

a coating (48) of electrically insulating material disposed on said mounting surface (20) of each of said sections (14), said coating (48) being less than one thousand microns in thickness, a plurality of circuit traces (50) spaced from one another on said coating (48) for preventing electrical conduction between said circuit traces (50) so that said coating (48) prevents electrical conduction from each of said circuit traces (50) to said heat sink (12), said plurality of light emitting diodes (52) disposed in spaces between adjacent ones of said circuit traces (50), each of said light emitting diodes (52) having a positive lead (54) and a negative lead (56), said leads (54, 56) of each of said light emitting diodes (52) being in electrical engagement with said adjacent ones of said circuit traces (50) for electrically interconnecting said circuit traces (50) and said light emitting diodes (52), an adhesive (46) of electrically conductive material securing said leads (54, 56) to said circuit traces (50), said light emitting diodes (52) on each of said sections (14) being electrically interconnected in series with one another, said light emitting diodes (52) on each of said sections (14) being electrically interconnected in parallel with said light emitting diodes (52) on other sections (14), a plurality of collimators (58) each encompassing one of said light emitting diodes (52) for focusing a scattered beam of light emitting from said light emitting diodes (52) into a parallel beam of light, said walls (24, 26) of said sections (14) including end walls (24) extending transversely from said mounting surface (20) at said end edges (18), said walls (24, 26) of said sections (14) including side walls (26) extending transversely from said mounting surface (20) at said side edges (16) to top side edges (30) so that said container is further defined by a rectangular shape, said first fins (32) extending transverse to said longitudinally extending support means (36) for allowing ambient air to flow between said first fins (32) and over said walls (24, 26) of said sections (14), a lens sheet (62) spanning and closing said open container between said top edges (28, 30) of said walls (24, 26) of each of said sections (14), said lens sheet (62) comprising a light transmitting material for allowing light emitting from said light emitting diodes (52) to pass therethrough, said lens sheet (62) including a plurality of prisms (64) for deflecting said beam of light emitting from said light emitting diodes (52), a lens seal (66) disposed between said lens sheet (62) and said top edges (28, 30) for sealing said lens sheet (62) to said top edges (28, 30) of said walls (24, 26) of said sections (14), a securing means (68) for securing said lens sheet (62) to said top edges (28, 30) of said walls (24, 26) of said sections (14), and a power supply (60) connected to said support means (36) for providing power to said light emitting diodes (52).

15. A light emitting assembly (10) as set forth in claim 14 wherein:

each of said first fins (32) extends continuously between said heat transfer surface (22) and said top edges (28, 30) on said side walls (26) and one of said end walls (24) of said sections (14), and said support means (36) presents a planar surface (38) extending longitudinally along the one end walls (24) without said first fins (32) of each of said sections (14) and a connecting means (40) connecting the one end wall (24) without said fins (32, 34) to said planar surface (38) for cantilevering said sections (14) from said planar surface (38).

16. An assembly (10) as set forth in claim 15 wherein said sections (14) are canted at angles relative to one another.

17. An assembly (10) as set forth in claim 15 wherein said sections (14) are disposed in non-parallel relationship relative to one another.

18. A light emitting assembly (10) as set forth in claim 14 wherein:

each of said first fins (32) extends continuously between said end walls (24) on said side walls (26) of said sections (14), and said support means (36) includes a plurality of bridges (42) interconnecting adjacent sections (14) to maintain said sections (14) connected together and a mounting bracket (44) extending transversely from at least one of said sections (14) for mounting said light assembly (10) to a wall.

19. An assembly (10) as set forth in claim 18 wherein:

each of said sections (14) includes a plurality of second fins (34) extending outwardly from said heat transfer surface (22) and disposed in spaced and parallel relationship to one another between said side edges (16) of each of said sections (14) for transferring heat away from said sections (14) to surrounding ambient air, said second fins (34) are disposed between said heat transfer surface (22) and said longitudinally extending support means (36) for allowing ambient air to flow between said second fins (34) and over said heat transfer surfaces (22) of said sections (14), and each of said second fins (34) extends continuously between said end edges (18) on said heat transfer surface (22) of said sections (14).

20. A method of fabricating a light emitting assembly (10) including the steps of:

forming a continuous strip of heat sink (12) having a cross section presenting a mounting surface (20), cutting the strip of heat sink (12) into a plurality of pieces each presenting the mounting surface (20), disposing light emitting diodes (52) on the mounting surface (20) of each section (14), extruding a continuous tube of heat sink (12) having a cross section presenting side walls (24) and end walls (26) and first fins (32) extending outwardly from the walls (24, 26) separate from said extruding the mounting surface (20), cutting the continuous tube of heat sink (12) into a plurality of wall units each presenting the side walls (24) and end walls (26) and first fins (32), connecting the mounting surface (20) of one of the sections (20) to one of the wall units, and extending a support means (36) longitudinally across the sections (14) for supporting the sections (14).

21. A light emitting assembly (10) comprising;

a heat sink (12) presenting a mounting surface (20) and an oppositely facing heat transfer surface (22), said heat sink (12) presenting side edges (16) extending between opposite end edges (18), a plurality of light emitting diodes (52) (LEDs) disposed on said mounting surface (20) of said heat sink (12), said heat sink (12) including end walls (24) extending transversely and linearly from said mounting surface (20) at said end edges (18) to top end edges (28) and side walls (26) extending transversely and linearly from said mounting surface (20) at said side edges (16) to top side edges (30), said walls (24, 26) extending about said side edges (16) and said end edges (18) so that said mounting surface (20) and surrounding walls (24, 26) define an open container with said light emitting diodes (52) and said mounting surface (20) at the bottom of said open container, said heat sink (12) including a plurality of first fins (32) extending outwardly from said walls (24, 26) and disposed in spaced relationship to one another for transferring heat away from said heat sink (12) to surrounding ambient air, and wherein at least one of said end walls (24) is flat and free of said fins (32).

* * * * *